United States Patent [19]

Dolby

[11] Patent Number: 4,940,191

[45] Date of Patent: Jul. 10, 1990

[54] RECLOSEABLE BOX TOP LID

[76] Inventor: Timothy S. Dolby, 5 Till St., Enfield, Conn. 06082

[21] Appl. No.: 330,078

[22] Filed: Mar. 29, 1989

[51] Int. Cl.[5] ..... B65D 39/04

[52] U.S. Cl. ..... 229/125; 220/307; 220/335; 229/125.13; 229/125.14

[58] Field of Search ..... 229/125, 125.08, 125.09, 229/125.13, 125.14, 125.17; 220/334, 335, 339, 307

[56] References Cited

U.S. PATENT DOCUMENTS

| | | | |
|---|---|---|---|
| 2,282,150 | 5/1942 | Andary | 229/125 |
| 2,826,348 | 3/1958 | Schroeder et al. | 229/125.09 |
| 2,885,084 | 5/1959 | Rocca | 229/125.09 |
| 2,889,976 | 6/1959 | Cantfort | 229/125.13 |
| 3,018,024 | 1/1962 | Foord | 229/125.09 |
| 3,180,552 | 4/1965 | Atkinson, Jr. | 229/125.08 |
| 3,265,282 | 8/1966 | Maxwell | 229/125.08 |
| 4,144,985 | 3/1979 | Kinslow | 220/307 |
| 4,491,252 | 1/1985 | Schmidt et al. | 229/125.08 |
| 4,732,315 | 3/1988 | Gunn | 229/125.09 |
| 4,771,936 | 9/1988 | Dolby | 229/125.08 |
| 4,795,065 | 1/1989 | Ashizawa et al. | 220/269 |

*Primary Examiner*—Gary Elkins

*Attorney, Agent, or Firm*—Richard L. Miller

[57] ABSTRACT

This recloseable box top lid is designed to frictionally lock in closed position and to be held fully open by hook and loop pile fasteners. Primarily, it consists of a base secured to the top of a forward opening in the box, and a cover is secured to the base and includes a hinge for pivoting the cover open. A frame is also secured in the box opening and is designed to frictionally lock the cover by engagement with a forward portion of a rib formed in the cover.

2 Claims, 1 Drawing Sheet

FIG. 1
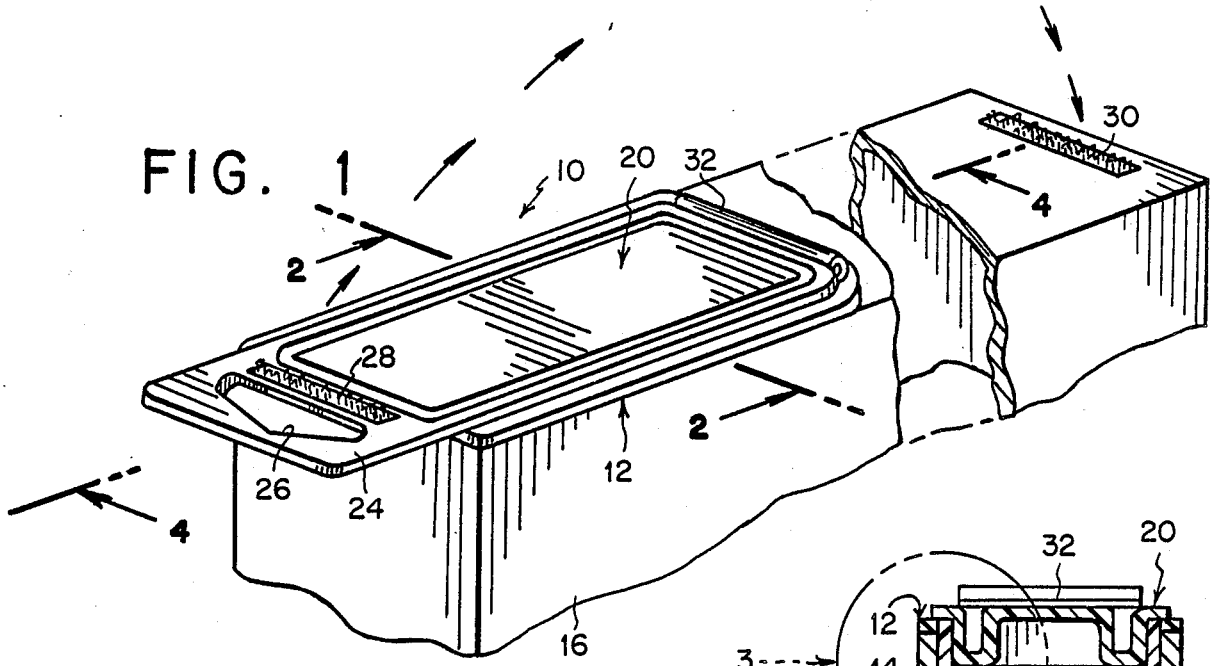
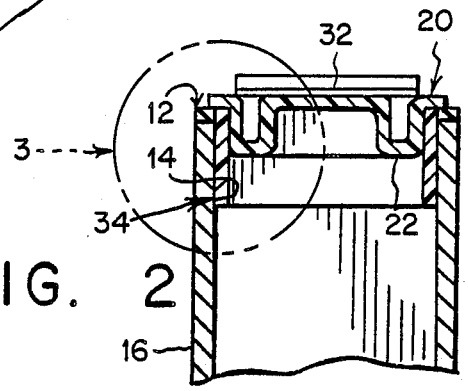
FIG. 2
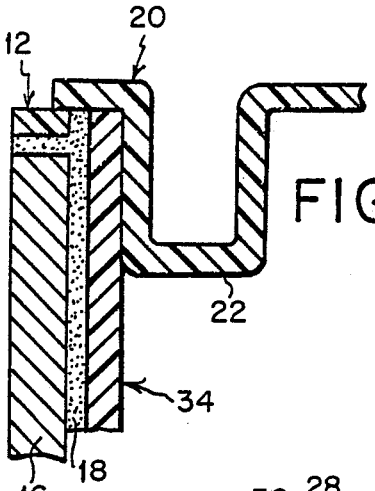
FIG. 3
FIG. 4
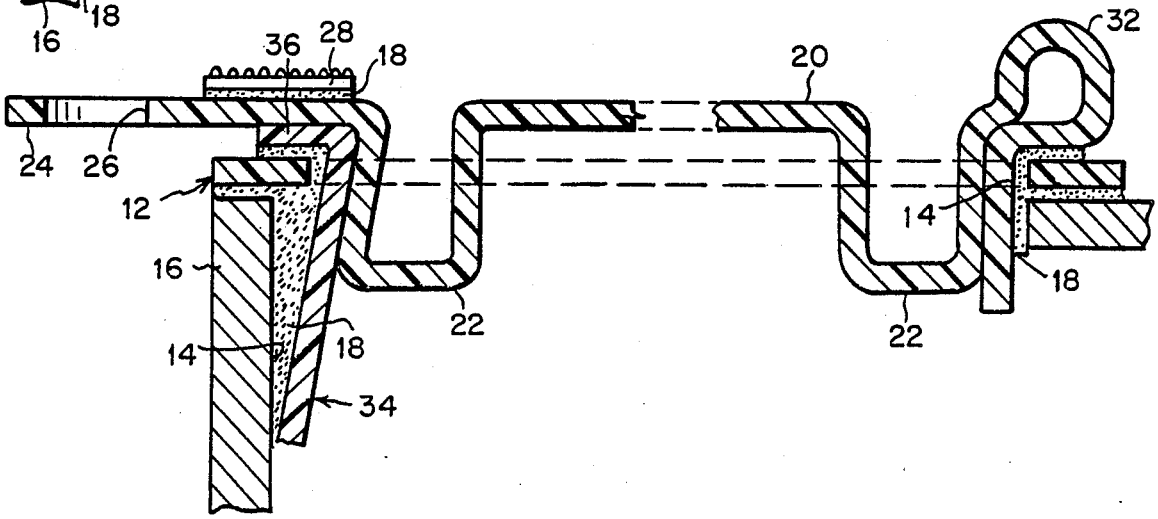

RECLOSEABLE BOX TOP LID

BACKGROUND OF THE INVENTION

The instant invention relates generally to box tops, and more particularly, to a recloseable box top lid.

Numerous box tops have been provided in the prior art that are adapted to be recloseable. For example, inventor's prior U.S. Pat. No. 4,771,936 is illustrative of such prior art. While this and other units may be suitable for the particular purpose to which they address, they would not be as suitable for the purpose of the present invention as hereafter described.

SUMMARY OF THE INVENTION

A primary object of the present invention is to provide a recloseable box top lid that will overcome the shortcomings of the prior art devices.

Another object is to provide a recloseable box top lid that will be hinged and will have a finger tab for the lifting thereof.

An additional object is to provide a recloseable box top lid that will be so designed, as to firmly close after being opened for dispensing some of its contents.

A further object is to provide a recloseable box top lid that is simple and easy to use.

A still further object is to provide a recloseable box top lid that is economical in cost to manufacture.

Further objects of the invention will appear as the description proceeds.

To the accomplishment of the above the related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention;

FIG. 2 is a fragmentary cross sectional view taken along line 2—2 of FIG. 1;

FIG. 3 is an enlarged fragmentary view taken in the dotted circle of arrow 3 in FIG. 2; and FIG. 4 is a fragmentary enlarged cross sectional view taken along line 4—4 in FIG. 1.

DETAILED DESCRIPTION OF THE PREFERRED EMBODIMENTS

Turning now descriptively to the drawings, in which like reference characters denote like elements throughout the several views, a lid 10 is shown to include an open base 12 that is fixedly secured in opening 14 of the top of a box 16 by an adhesive 18, as best seen in FIG. 3. A rectangular cover 20 is provided and includes a rib 22 formed therein for strength and rigidity. Base 12 and cover 20 are fabricated of plastic material and a forward portion of cover 20 includes a finger tab 24 with an opening 26 therethrough for firmly gripping tab 24. The tab overhangs the front of the box 16 and a hook pile fastener 28 is fixedly secured to the top of tab 24, for mating engagement with a loop pile fastener 30 fixedly secured to the top of the rear of the box 16.

Fasteners 28 and 30 are secured by adhesive 18, and when cover 20 is fully opened, fasteners 28 and 30 engage with each other and keep the cover 20 open when a quantity of a product in box 16 is being dispensed therefrom.

The rear end of cover 20 is downwardly formed and fixedly secured by adhesive 18 in the rear of opening 14 of box 16, and a loop 32 is formed adjacent to the rear end of cover 20 and is also secured to the rear top of base 12 by adhesive 18, as best seen in FIG. 4. The loop 32 extends upward and serves as a hinge for the cover 20 to pivot upward and rearward.

A frame 34 is provided and also made of plastic, and the sides and front end of frame 34 are fixedly secured to the inside surface of box 16 by adhesive 18. The front end of frame 34 is angled forward at the bottom, and an upper lip portion 36 is formed forwardly of box 16 and is fixedly secured to the forward top of the base 12 by adhesive 18. The angled forward end of frame 34 is designed, so as to provide friction locking of cover 20 when engaged with the forward portion of the rib 22 when the cover is closed, thus preventing accidental opening of cover 20, seen in FIG. 4.

In use, a person grips tab 24 with their fingers and pulls upward, causing the forward portion of the rib 22 to disengage with the angled forward end of the frame 34. The cover 20 is then pivoted rearward by the loop 32 until the fasteners 28 and 30 engage and hold the cover 20 open.

After dispensing the desired amount of the contents of the box 16, the cover 20 is pulled upward and pivoted forward, and the front end is pushed downward to cause the forward portion of the rib 22 to frictionally engage with the angled forward end of the frame 34.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A reclosable box top lid which comprises:

(a) a base secured to a top of an opening in a front end of a box;

(b) a cover pivotally secured to and received in said base;

(c) a frame secured in said box and providing frictional locking means for a forward portion of said cover; and (d) a tab over-hangs said box and is integrally attached to said cover and provides finger gripping means for lifting and disengaging said forward portion of said cover, wherein said cover includes a continuous rib formed underneath that engages with said frame that is fixedly secured in the opening in said front end of said box, and a forward portion of said rib frictionally engages with an angled forward portion of said frame and provides said frictional locking means, and said frame is fixedly secured to inside surfaces of said box wherein said base is fixedly secured to said front end of said box and said rib is removably received in an opening through said base, and a loop is formed in an end portion of said cover and provides hinge means for pivoting said cover.

2. A recloseable box top lid as set forth in claim 1, wherein a mating pair of hook and loop pile fasteners are fixedly secured to said tab and a rear top surface of said box, and when engaged, retains said cover in a full open condition whereby a quantity of contents may be poured from said box.

* * * * *